US005379831A

United States Patent [19]

Carpenter

[11] Patent Number: 5,379,831

[45] Date of Patent: Jan. 10, 1995

[54] HEAT PIPE HEAT EXCHANGER

[75] Inventor: Neil N. Carpenter, Katy, Tex.

[73] Assignee: Hudson Products Corporation, Houston, Tex.

[21] Appl. No.: 199,420

[22] Filed: Feb. 22, 1994

[51] Int. Cl.[6] ..... F28D 15/02

[52] U.S. Cl. ..... 165/104.27; 165/104.14; 165/134.1

[58] Field of Search ..... 165/104.27, 134.1, 104.14

[56] References Cited

U.S. PATENT DOCUMENTS 5,033,539 7/1991 Kohtaba ..... 165/104.27

FOREIGN PATENT DOCUMENTS 155188 12/1980 Japan ..... 165/104.27

175791 10/1983 Japan ..... 165/134.1

*Primary Examiner*—John K. Ford

*Attorney, Agent, or Firm*—Michael L. Hoelter; Robert J. Edwards

[57] ABSTRACT

A heat pipe heat exchanger utilizing a working fluid such as water incorporates heating means for preventing the freezing of the working fluid when the heat exchanger is non-operational. These heating means are located at or near the heat pipe in the lower region of the heat exchanger so as to prevent the freezing of the working fluid. Trapped gases within the heat pipe caused by the reaction of the working fluid with the metallurgy of the pipe are released by heating the working fluid with the heating means in order to increase the gas pressure within the heat pipe until the pressure is greater than the external pressure of the heat pipe. A venting means is used to vent the trapped gases from the heat pipe due to the force of the pressure within the heat pipe.

3 Claims, 1 Drawing Sheet

HEAT PIPE HEAT EXCHANGER

FIELD OF THE INVENTION

This invention pertains to heat pipe heat exchangers which use water as the working fluid in general, and more particularly to a means of preventing this working fluid from freezing while also venting any hydrogen gas that may be generated within the heat exchanger by the reaction of the working fluid with the tube metallurgy.

BACKGROUND OF THE INVENTION

It is common for heat pipe heat exchangers that utilize water as the working fluid to have two basic problems. The first is the possibility that the water working fluid will freeze when the units are shut down and the second is the need to vent any hydrogen gas that is generated within the heat exchanger due to the water working fluid reacting with the tube metallurgy.

With respect to the first problem, when an inclined heat exchanger is shut down, such as for repairs, fluid will collect in the lower portion (the hot or gas side) of the inclined heat pipes. Thus, if certain conditions occur, this fluid may freeze resulting in damage to the heat pipe tube due to the expansion of the fluid when it freezes.

With respect to the second problem, water working fluid often reacts with the tube metallurgy (generally carbon steel) to generate hydrogen gas. This hydrogen gas blankets off or insulates the interior surface of the heat tube from the working fluid thereby reducing any heat transfer that may occur. To alleviate this condition and to restore the efficiency of the heat exchange unit, the hydrogen gas must be vented, or "burped", from the tube on a somewhat regular basis.

In the past, when addressing the first problem, it was common to add an anti-freeze solution to the water working fluid in order to lower the freezing point of the fluid. Provided sufficient quantities of anti-freeze were added and this substance did not break down during use, it could be generally assumed that this problem was, at least temporarily, resolved. However, should the anti-freeze solution settle out or break down, such as by forming deposits in the heat tube, the efficiency and productivity of the heat exchanger would be impaired.

Regarding solutions to the second problem, various devices have been developed that are capable of venting hydrogen gas from the heat tube. Some such devices consist of typical pressure relief valves. Other solutions have included attempts to block the generation of hydrogen gas within the tube through chemical reaction, lining, or the like. However, unless these solutions are consistently monitored for proper operation, hydrogen gas may be generated which is not released soon thereafter. Additionally, to release such gas after it has been generated, it was first necessary to pressurize the system. Consequently, the method of achieving such pressurization must be continuously monitored to prevent any pressure build-up from occurring.

It is thus an object of this invention to provide a means of resolving both of the above identified problems without requiring special or elaborate equipment. Another object of this invention is to resolve both problems with the same piece of equipment thereby eliminating the need for separate or duplicate machinery. Yet another object of this invention is to provide a solution whose operation can be easily monitored and one which can be repaired quickly and easily, or replaced, should it become necessary to do so. Another object of this invention is to provide a solution that can be selectively activated such that it may be removed from service when not needed thereby reducing energy requirements. Still another object of this invention is to provide a solution that is operational for water working fluids in carbon steel heat tubes as well as for other types of working fluids in heat tubes of different metallurgy. These and other objects and advantages of this invention will become obvious upon further investigation.

SUMMARY OF THE INVENTION

A heat pipe heat exchanger having a plurality of parallel heat pipes therein is configured with both a hot side and a cold side. This heat exchanger incorporates a working fluid within the heat pipes with this working fluid transferring heat from the hot side of the heat exchanger to the cold side. Heating means are located in the hot side of the heat exchanger adjacent the heat pipes for maintaining the temperature of the working fluid within the heat pipes above freezing when not in use. Venting means are also supplied so as to vent gas from the cold side of the heat pipes, this gas being vented by its pressurization within the heat pipes by the heating of the working fluid within the heat pipe by the heating means.

DETAILED DESCRIPTION OF THE INVENTION

Figure 1:
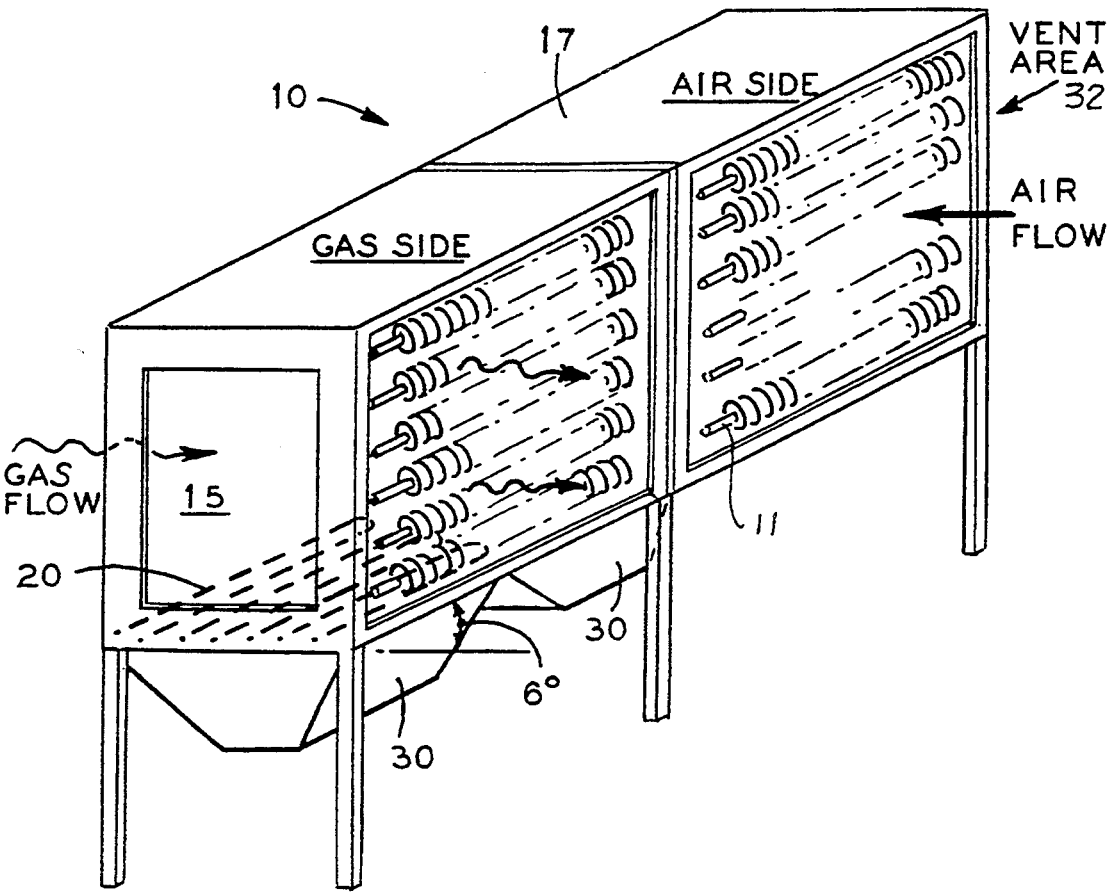
FIG. 1 is a pictorial view of the inclined heat exchanger illustrating typical fluid flow directions and the location of the heater for burping and freezing protection.
Figure 2:
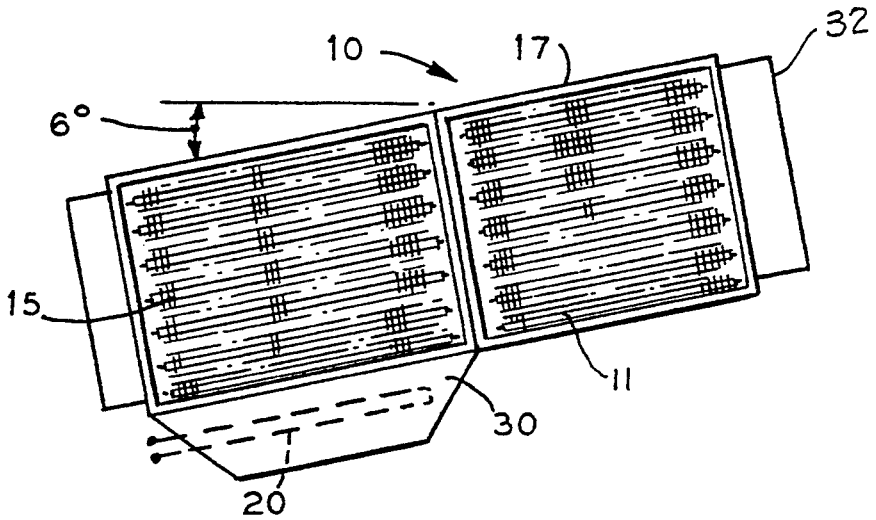
FIG. 2 is a pictorial side view, partially cut away, of the inclined heat exchanger, illustrating its incline in greater detail.

The present invention embodied in FIG. 1 comprises an improved heat pipe heat exchanger, generally designated 10, which utilizes a working fluid such as water. After installation at the desired facility, the various internal parallel heat pipes 11 contained within heat exchanger 10 are inclined such that there is an upper or higher portion 17 (usually the "cold" or "air" side) and a lower portion 15 (usually the "hot" or "gas" side). Consequently, when heat exchanger 10 is not in use, the working fluid will normally collect in lower portion 15 of heat exchanger 10.

A heating means 20, such as an electric heater or the like is provided as shown adjacent the heat pipes in lower portion 15 for heating the working fluid collected in this region of heat exchanger 10. Generally, heater 20 is powered by electricity for ease of installation, but other means of supplying heat to this lower region 15 are equally suitable. As stated, heater 20 is placed in or near the various heat pipes 11 at any desired location or orientation so as to prevent freezing of the working fluid within heat exchanger 10. In this embodiment, heater 20 is shown located within covering 30. When heat exchanger 10 is non-operational, such as during maintenance, or when there is a possibility of the working fluid freezing within heat pipes 11, heater 20 can be activated in order to supply heat so as to prevent the freezing of the working fluid.

Heater 20 installed within heat exchanger 10 also provides for the release of any gases trapped within the various heat pipe 11. These gases include hydrogen which is a common product of the reaction of the working fluid with the metallurgy of the heat pipe. By using heater 20 to heat the working fluid within the individual heat pipe of heat exchanger 10, gas pressure is created inside heat pipe 11 which is higher than the external pressure or atmospheric pressure outside heat pipe 11. Consequently, by utilizing venting means 32, these trapped gases are forced out of heat pipe 11 by the pressure created by heating the working fluid with heating means 20. This venting process permits the trapped gases to be released, thereby increasing the efficiency of heat exchanger 10.

While a specific embodiment of the invention has been shown and described in detail to illustrate the application of the principles of the invention, it will be understood that the invention may be embodied otherwise without departing from such principles.

What is claimed is:

1. A method of heating and venting the working fluid within a heat pipe heat exchanger, this heat exchanger having both a hot side and a cold side and a plurality of parallel elongated heat pipe therein, comprising the step of:

(a) installing heating means in a lower region of the hot side of the heat exchanger adjacent selected heat pipe for maintaining the temperature of the working fluid within said selected heat pipe above freezing temperatures, said heating means being positioned generally parallel to said selected heat pipe and heating said selected heat pipe along its longitudinal axis within said hot side; and, (b) venting gas which may accumulate within said selected heat pipe by initially pressurizing said gas by heating the working fluid contained within said selected heat pipe via said heating means.

2. The method as set forth in claim 1 further comprising the step of using water as the working fluid.

3. The method as set forth in claim 2 further comprising the step of inclining the heat pipe within the heat exchanger, these inclined heat pipe having an upper elevation associated with the cold side of the heat exchanger and a lower elevation associated with the hot side of the heat exchanger.

* * * * *